US011771292B1

(12) United States Patent
Bisson et al.

(10) Patent No.: US 11,771,292 B1
(45) Date of Patent: Oct. 3, 2023

(54) FLOOR SCRUBBER APPARATUS WITH RELEASABLY LOCKING HANDLE

(71) Applicant: Karma 360, Inc., Huntington Beach, CA (US)

(72) Inventors: Montgomery Bisson, Huntington Beach, CA (US); Jesus J. Peña, Yorba Linda, CA (US)

(73) Assignee: KARMA 360, INC., Huntington Beach, CA (US)

( * ) Notice: Subject to any disclaimer, the term of this patent is extended or adjusted under 35 U.S.C. 154(b) by 29 days.

(21) Appl. No.: 17/471,880

(22) Filed: Sep. 10, 2021

Related U.S. Application Data

(60) Provisional application No. 63/123,013, filed on Dec. 9, 2020, provisional application No. 63/076,648, filed on Sep. 10, 2020.

(51) Int. Cl.
*A47L 11/40* (2006.01)
*A47L 11/283* (2006.01)

(52) U.S. Cl.
CPC ..... *A47L 11/4075* (2013.01); *A47L 11/283* (2013.01); *A47L 11/4055* (2013.01)

(58) Field of Classification Search
CPC ... A47L 11/4075; A47L 11/4055; B25G 1/04; B25G 1/06
See application file for complete search history.

(56) References Cited

U.S. PATENT DOCUMENTS 3,013,287 A 5/1959 Descarries
3,291,540 A * 12/1966 Doersam ..... A47L 11/4075 403/327
5,327,610 A * 7/1994 Smith ..... A47L 11/4075 15/49.1

(Continued)

FOREIGN PATENT DOCUMENTS

EP 3 508 106 A1 7/2019
EP 3 597 093 A1 1/2020

(Continued)

OTHER PUBLICATIONS

Translation of WO-2019219582-A1 (Year: 2022).*

*Primary Examiner* — Don M Anderson
*Assistant Examiner* — Sarah Akyaa Fordjour
(74) *Attorney, Agent, or Firm* — Rod D. Baker

(57) ABSTRACT

An upright walk-behind microscrubber apparatus including a handle assembly connected to a base assembly, and featuring an improved handle function. The handle assembly is manipulated by the user to operate the apparatus. The apparatus provides a releasable, lockable, joint assembly that connects the handle assembly to the base assembly, whereby the handle assembly is pivotally connected to the base assembly. The joint assembly permits the handle assembly to be disposed in a fully released configuration in which the handle assembly is freely pivotal relative to the base assembly, or in a fully locked position in which the handle assembly is temporarily locked in an upright orientation. The joint assembly permits the base assembly to be (Continued)

released to a use position generally parallel to the floor, or releasably locked in a storage position generally parallel to the handle assembly but with the base assembly's scrubbing brushes removed from the floor.

18 Claims, 10 Drawing Sheets

(56) References Cited

U.S. PATENT DOCUMENTS

| | | | | |
|---|---|---|---|---|
| 6,421,868 | B1 * | 7/2002 | Tran | A47L 11/4075 15/49.1 |
| 8,887,352 | B2 * | 11/2014 | Muhlenkamp | A47L 9/0054 15/411 |
| 9,826,874 | B2 | 11/2017 | Franke et al. | |
| 2004/0134016 | A1 | 7/2004 | Kisela et al. | |
| 2007/0209138 | A1 | 9/2007 | Tran et al. | |
| 2008/0216279 | A1 | 9/2008 | Jeff et al. | |
| 2012/0110775 | A1 | 5/2012 | Krebs | |
| 2012/0222234 | A1 * | 9/2012 | DeJonge | A47L 11/408 134/117 |
| 2019/0030704 | A1 | 1/2019 | Franke | |
| 2019/0343357 | A1 | 11/2019 | Franke | |
| 2019/0380554 | A1 * | 12/2019 | Kasper | A47L 11/26 |

FOREIGN PATENT DOCUMENTS

| | | | | |
|---|---|---|---|---|
| WO | 2019/219580 | A1 | 11/2019 | |
| WO | 2019/219582 | A1 | 11/2019 | |
| WO | WO-2019219582 | A1 * | 11/2019 | A47L 11/305 |

* cited by examiner

FLOOR SCRUBBER APPARATUS WITH RELEASABLY LOCKING HANDLE

CROSS-REFERENCE TO RELATED APPLICATIONS

This application claims the benefit of U.S. Provisional Patent Application Ser. No. 63/076,648 entitled "Floor Scrubber Apparatus with Releasably Locking Handle," filed on 10 Sep. 2020, the entire disclosure of which is hereby incorporated by reference. This application also claims the benefit of the filing of U.S. Provisional Patent Application Ser. No. 63/123,013 entitled "Floor Scrubber Apparatus With Vacuum Motor Protection," filed on 9 December 2020, whose contents also are incorporated herein by reference

BACKGROUND OF THE INVENTION

Field of the Invention

This invention relates to upright floor scrubber machines, particularly to the handle assemblies of such scrubbers, and specifically to an articulated, releasably locking handle mechanism for an upright scrubber.

Background of the Invention

Motorized floor scrubber machines are long known in the art as useful for cleaning floors using a scrubbing action. Small upright floor scrubbers devised for walk-behind operation by a single person are sometimes called "microscrubbers." There also are known in the art of floor scrubbers a variety of powered, self-propelled machines upon which a user rides while operating the device; U.S. Pat. No. 10,555,657 to Pedlar et al. typifies the current art of such "riding" floor cleaning devices. Such riding floor scrubbers are not significantly germane to the invention of the present disclosure.

Microscrubbers are configured for operation by a user who walks behind the device. The user grasps a handle assembly which is connected to a base assembly. The handle assembly is used to control the operation of the base assembly, which base assembly contains the cleaning components that contact and clean the surface of the floor as the microscrubber moves across the floor. Known microscrubbers are usually for wet cleaning action, in which the device supplies a cleaning solution, typically water or water with diluted cleaning chemical, to the floor during the scrubbing action. Some existing microscrubbers are self-propelled, such that the user need only steer and control the device without having also to provide the main motive force to push/pull the device across the floor. Microscrubbers are normally electrically powered by means of an electrical cord that plugs into a wall socket of the building structure whose floor is to be cleaned, or alternatively may be battery powered. In either case, the electrical power is harnessed to energize one or more motors in the device, which motors drive fluid pumps and one or more scrubbing elements. During operation, the microscrubber device applies water, often from an onboard supply tank and sometimes mixed with detergents or other cleaning agents, to the floor, while powered scrubbing elements (typically one or more rotating or counter-rotating bristle brushes) provide a scouring or scrubbing action to the wetted floor. Squeegee components may be provided in a trailing location behind the scrubbing elements to wipe the floor dry and to collect the used water, normally via a vacuum motor mounted on the base or handle assembly of the device, which used water may be pumped back up into the supply tank, or to a separate waste or solution recovery tank.

As mentioned, most microscrubbers feature a base assembly from which a handle assembly extends upward. The handle assembly may have a pivotal connection to the base assembly to permit the user to tip or tilt the handle assembly, relative to the base assembly, during operation so to enhance versatility of use and ease of steering. The base assembly has a frame and/or housing which mounts the scrubbing element(s) for powered rotary movement while in contact with the floor. The base assembly usually also contains the motor(s) which drive the scrubbing element(s). The handle assembly normally has some type of handle grip(s) with which the user steers the microscrubber across the floor during use; various control switches typically also are provided on the handle assembly, on or near the grip(s), for regulating the electrically powered functions of the device.

Microscrubber devices typifying the state of the art are disclosed by, for example: U.S. Patent Application Publication No. 20190343357 by Franke; and U.S. Patent Application Publication No. 2013/0133146 by Brueckner et al., which are incorporated herein by reference.

There is, however, an unmet need for a floor microscrubber device with a versatile handle that permits the handle assembly to be releasably locked in more than one position. There is needed a microscrubber which permits a user to controllably lock the handle assembly in either an upright use position with the cleaning elements (brushes) on the floor or in a storage configuration with the brushes out of contact with the floor, and yet allows the user readily to release the handle from such a locked use position.

With the foregoing background, the presently disclosed invention was developed.

SUMMARY OF THE INVENTION

There is disclosed an upright walk-behind microscrubber apparatus, featuring an improved handle function and feature. The microscrubber includes as main subassemblies an upright handle assembly movably connected to a base assembly. The handle assembly is manipulated by the user to steer and operate the apparatus, and has a pair of handle grips by which the user manually grasps the apparatus during operation. A control panel at the top end of the handle assembly includes various switches, including on-off toggle switches, for regulating the electrically powered components of the apparatus. The handle assembly includes various pumping, tubing, and container components for recovering the aqueous cleaning solution applied to the floor during floor cleaning operations. The base assembly houses one or more electrically powered motors for driving one or more rotary scrubbing brushes for scrubbing a floor, and a container holding aqueous cleaning solution. The base assembly also includes a squeegee assembly and vacuum motor for recovering from the floor the water the apparatus has applied to the floor. Water is pumped to the brush(es) from a container on the base of the unit via a flexible delivery tube, while used "dirty" water collected under the base assembly and in front of the squeegee assembly is sucked, via a flexible return tube, to the handle assembly to a container thereon.

The inventive apparatus provides an advantageous articulated joint assembly that connects the handle assembly to the base assembly, such that the handle assembly is connected to, but selectively widely pivotal in relation to, the base assembly. The connection is by a specialized joint assembly that includes an intermediate linking member which connects a main handle shaft, secured within the handle assembly, to a mounting hub on a base plate of the base assembly. The joint is included within a releasable, lockable, joint assembly that permits the base assembly easily to be released to a use position generally parallel to the floor, or a storage position generally parallel to the handle assembly with the brushes removed from the floor. The joint assembly also permits the handle assembly to be disposed in a fully released configuration in which the handle assembly is freely pivotal and swivelable relative to the base assembly, or in a fully locked position in which the handle assembly is locked in an orientation generally vertical to the base assembly (in its use position upon the floor).

The releasably lockable joint assembly includes joint elements that, when surrounded by a slidable sleeve, are prevented from pivoting, thereby to immobilize the handle assembly relative to the base assembly. But when the sleeve is deliberately withdrawn from around the joint elements, they are free to pivotally articulate, so that the handle assembly is controllably movable relative to the base assembly. The releasable, lockable, joint assembly includes a number of components, most but not all of which are situated generally centrally within the interior of the handle assembly. Elements of the joint assembly include a hollow, generally tubular main handle shaft, a control shaft, a rigid tubular locking sleeve, a linking member, and a base clevis. The base clevis is secured to, or integrated with, the mounting hub on the base assembly. Regulated axial shifting and radial twisting movements applied, by a user, to the releasably lockable joint assembly function to lock and release the assembly.

BRIEF DESCRIPTION OF THE DRAWING

The attached drawings, which form part of this disclosure, are as follows.

The drawings are not necessarily to scale, either within a view or between views. Like label numerals are used to designate like elements or components among the views.

DETAILED DESCRIPTION OF THE INVENTION

The present invention is not to be limited in scope by the specific embodiments described below, which are intended as exemplary illustrations of individual aspects of the invention. Functionally equivalent methods and components fall within the scope of the invention. Indeed, various modifications of the invention, in addition to those shown and described herein, will become apparent to those skilled in the art from the following description. Such modifications are intended to fall within the scope of the appended claims. Throughout this application, the singular includes the plural and the plural includes the singular, unless indicated otherwise.

The invention relates to a motorized apparatus for cleaning floors, being an upright walk-behind "microscrubber," with an improved handle function and feature. The scrubber apparatus has a base assembly disposable (i.e., generally horizontally) upon a floor and a handle assembly extending upwardly from the base assembly. The scrubber apparatus includes a releasably lockable joint assembly for connecting the handle assembly to the base assembly, whereby the handle assembly may be temporarily disposed in a locked upright position in relation to the base assembly, and may be released for freely pivotal movement, in at least two degrees of freedom, in relation to the base assembly. The at least two degrees of freedom include pivotal motion forward and backward, and laterally side-to-side. In the preferred embodiment, the handle assembly, while tilted from an imaginary vertical axis, is swingably pivotal through 360° around that axis (as viewed from above).

The releasably lockable joint assembly of the scrubber apparatus has a tubular main handle shaft within the handle assembly, a control shaft slidable axially within the main handle shaft, and a tubular locking sleeve around the main handle shaft and slidable axially along the main handle shaft, wherein the locking sleeve is interconnected with the control shaft and the locking sleeve and control shaft are movable together unitarily, and are concurrently slidable axially along the main handle shaft. The lockable joint assembly also includes a linking member pivotally connected to a bottom end of the main handle shaft, and a means for pivotally connecting the linking member to the base assembly. By the foregoing, the releasably lockable joint assembly is movable between a fully locked configuration in which the locking sleeve surrounds the linking member and at least a portion of the means for pivotally connecting the linking member to the base member, so that the handle assembly is disposed in the locked upright position, and a fully released configuration in which the locking sleeve is withdrawn from surrounding the linking member and any portion of the means for pivotally connecting the linking member, so that the handle assembly is freely pivotal in relation to the base assembly.

Figure 1:
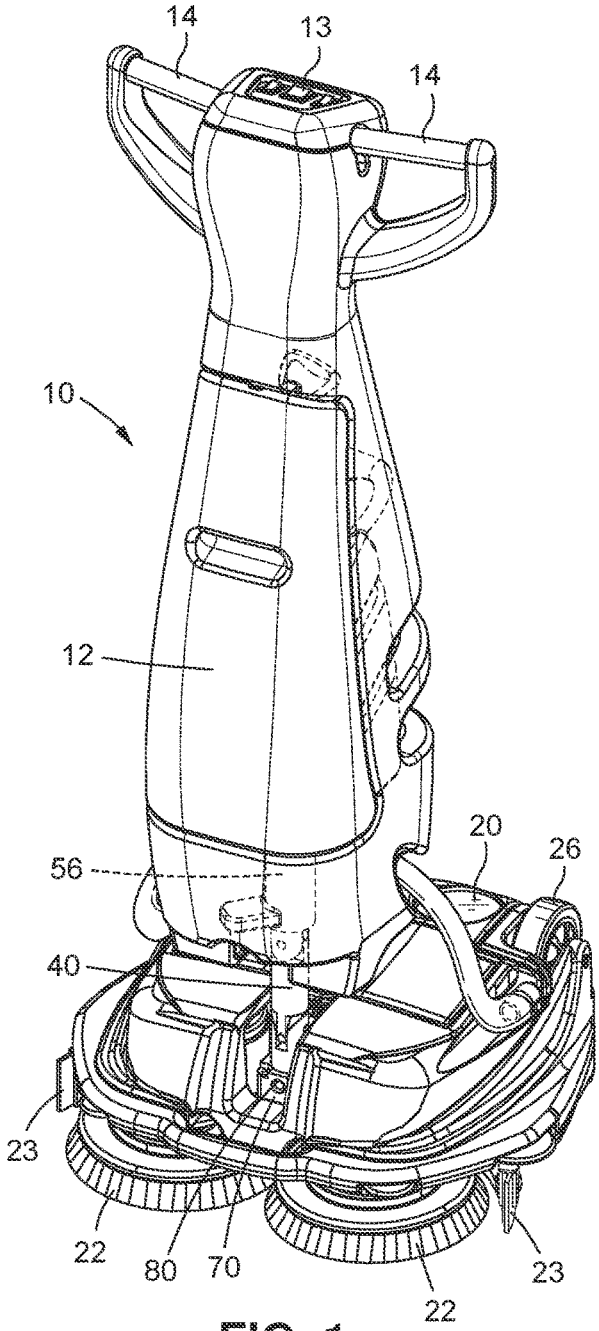
FIG. 1 is a perspective front view of an embodiment of an upright scrubber apparatus having a handle assembly and a base assembly generally according to the present invention, in the fully upright position and with selected internal components shown in dashed hidden lines.
Figure 2:
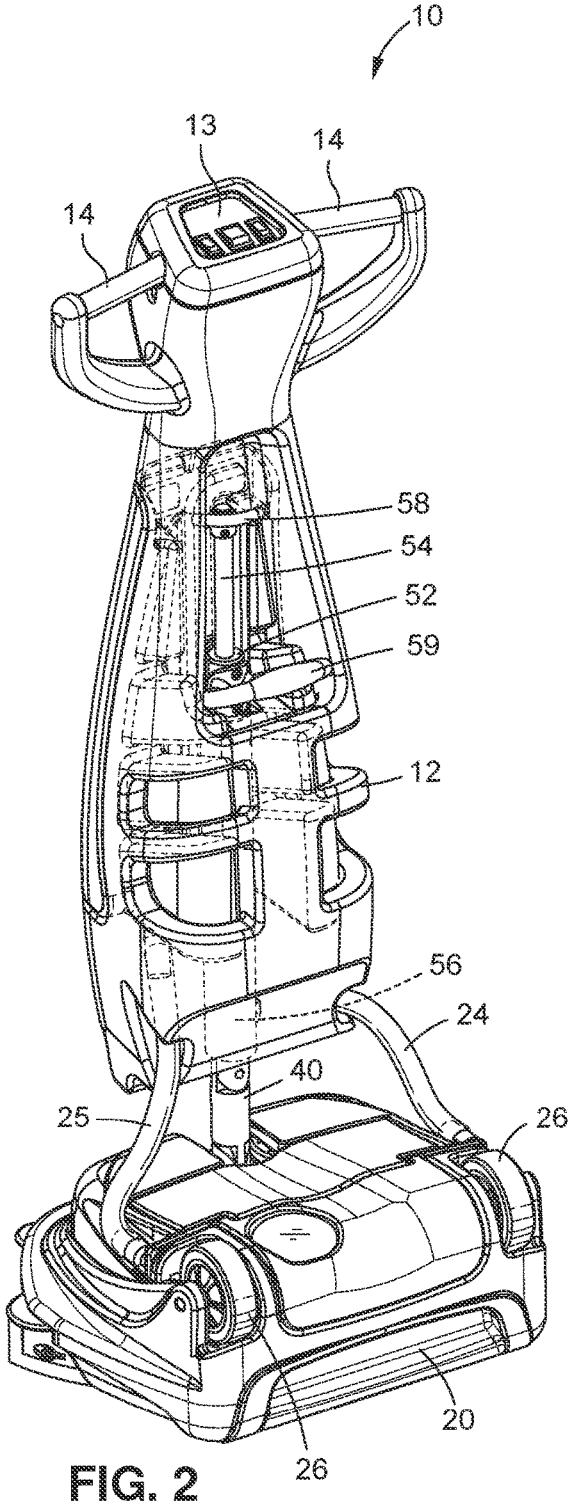
FIG. 2 is a perspective rear view of an embodiment of an upright scrubber apparatus according to the present invention, with selected internal components shown in dashed hidden lines.
Figure 3:
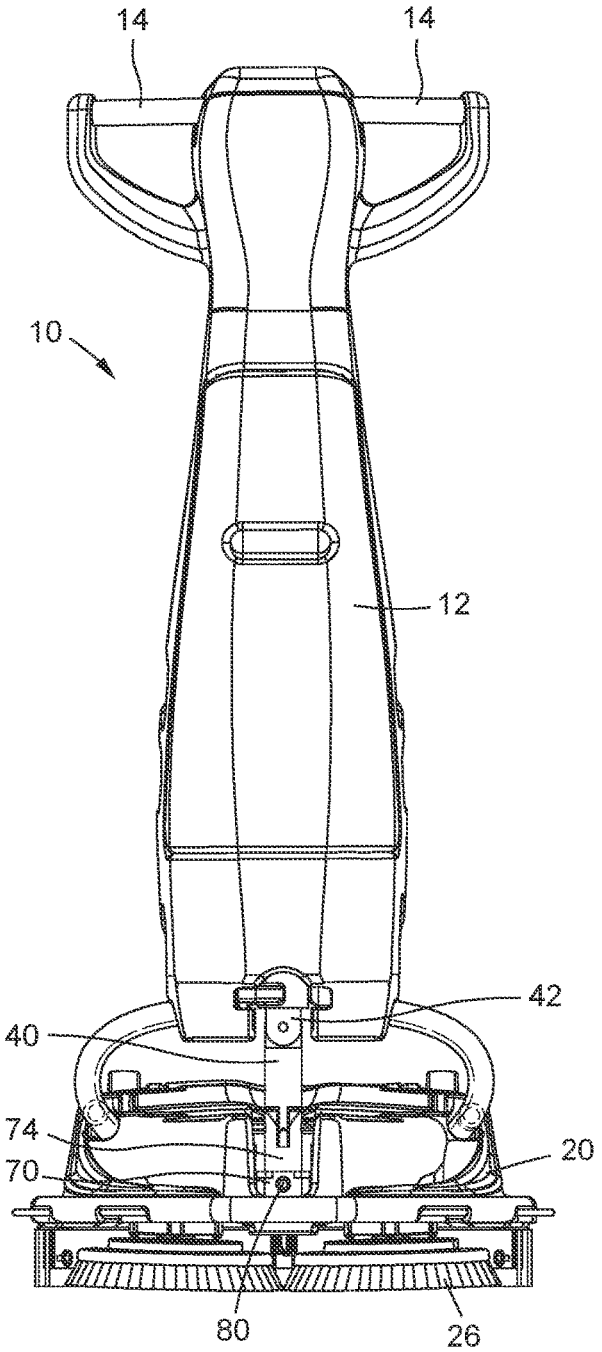
FIG. 3 is a front view of the scrubber apparatus seen in FIGS. 1 and 2.

Combined reference to FIGS. 1-4 provides an overview of an embodiment of an upright microscrubber apparatus 10 according to the present disclosure; FIGS. 1 and 3 are differing front views, FIG. 2 is a perspective rear view, and FIG. 4 offers a side view. The floor cleaning microscrubber 10 has an upright handle assembly 12 movably connected to a base assembly 20.

The handle assembly 12 includes elements to provide rigidity and structural integrity for the apparatus 10. The handle assembly 12 is manipulated by the user to steer and operate the apparatus 10 by use of the handle grips 14. Handle assembly 12 has a pair of handle grips 14 by which the user manually grasps the apparatus 10 during operation. A control panel 13 at the top end of the handle assembly 12 includes various switches, including for example on-off toggle switches, for regulating the electrically powered components of the microscrubber apparatus 10. Handle assembly 12 also houses various pumping, tubing, and container components for recovery of the aqueous cleaning solution that is applied to the floor during floor cleaning operations.

Figure 4:
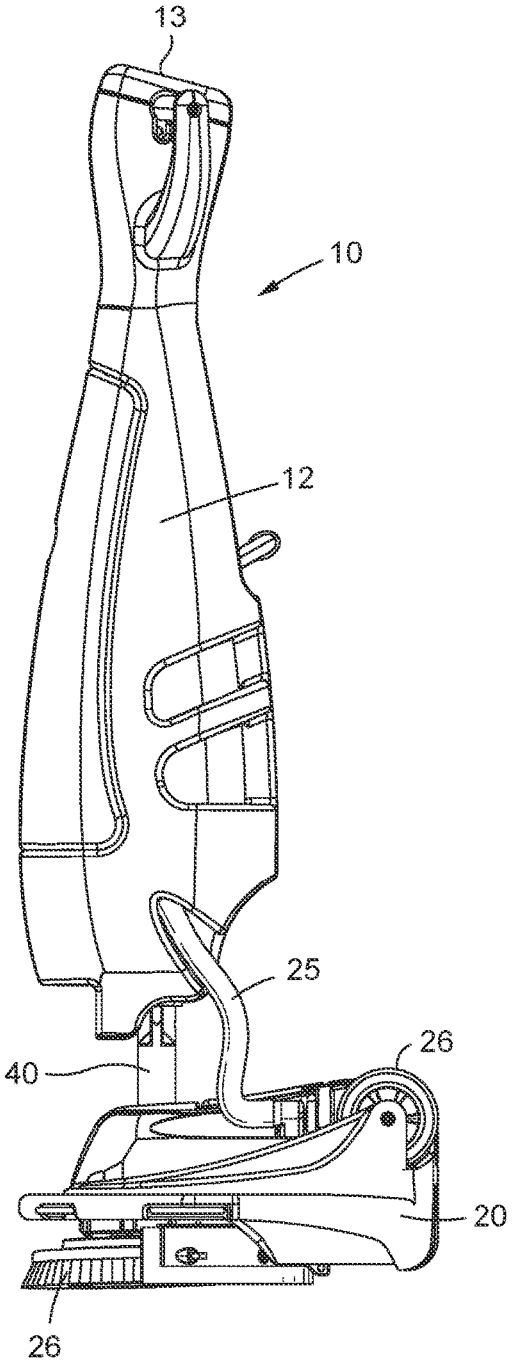
FIG. 4 is a left side view of the scrubber apparatus seen in FIG. 3.

The base assembly 20 also has generally conventional base structural elements to lend foundational support and integrity to the apparatus 10. Base assembly 20 houses one or more electrically powered motors for driving a pair of rotary scrubbing brushes 22 for scrubbing a floor. The brushes 22 may counter-rotate, the right brush rotating counter-clockwise (viewed from above) and the left brush rotating clockwise, so to provide a measure of self-propulsion to the apparatus 10 during operation. The base assembly 20 also has a squeegee assembly 23 and vacuum motor for recovering the water that the apparatus 10 has applied to the floor. "Clean" water or cleaning solution is pumped from a container on the base assembly 20 to the brushes 22 on the base assembly 20, while used "dirty" water collected under the base assembly and in front of the squeegee assembly 23 is sucked or recovered, via a flexible return tube 25, back to the handle assembly to a container thereon. As best seen in FIGS. 2 and 4, the base assembly 20 preferably rotatably mounts, near its rear upper corner portions, a pair of wheels 26 that facilitate rolling movement of the apparatus 10 when positioned in an upright storage position (FIG. 20).

Figure 5:
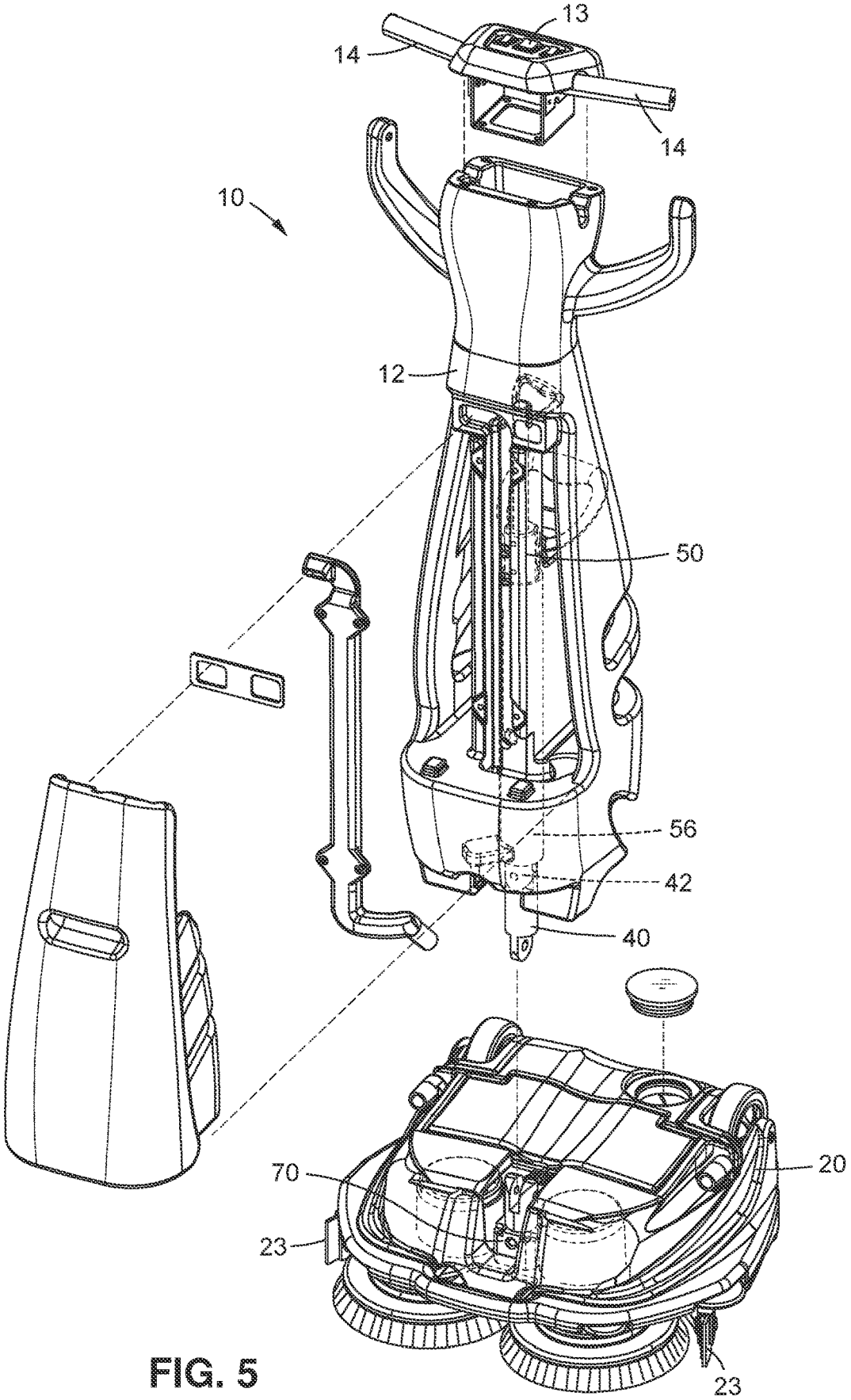
FIG. 5 is a perspective front view of an apparatus according to the present invention, partially exploded to reveal selected internal features and with some internal components shown in dashed hidden lines.
Figure 6:
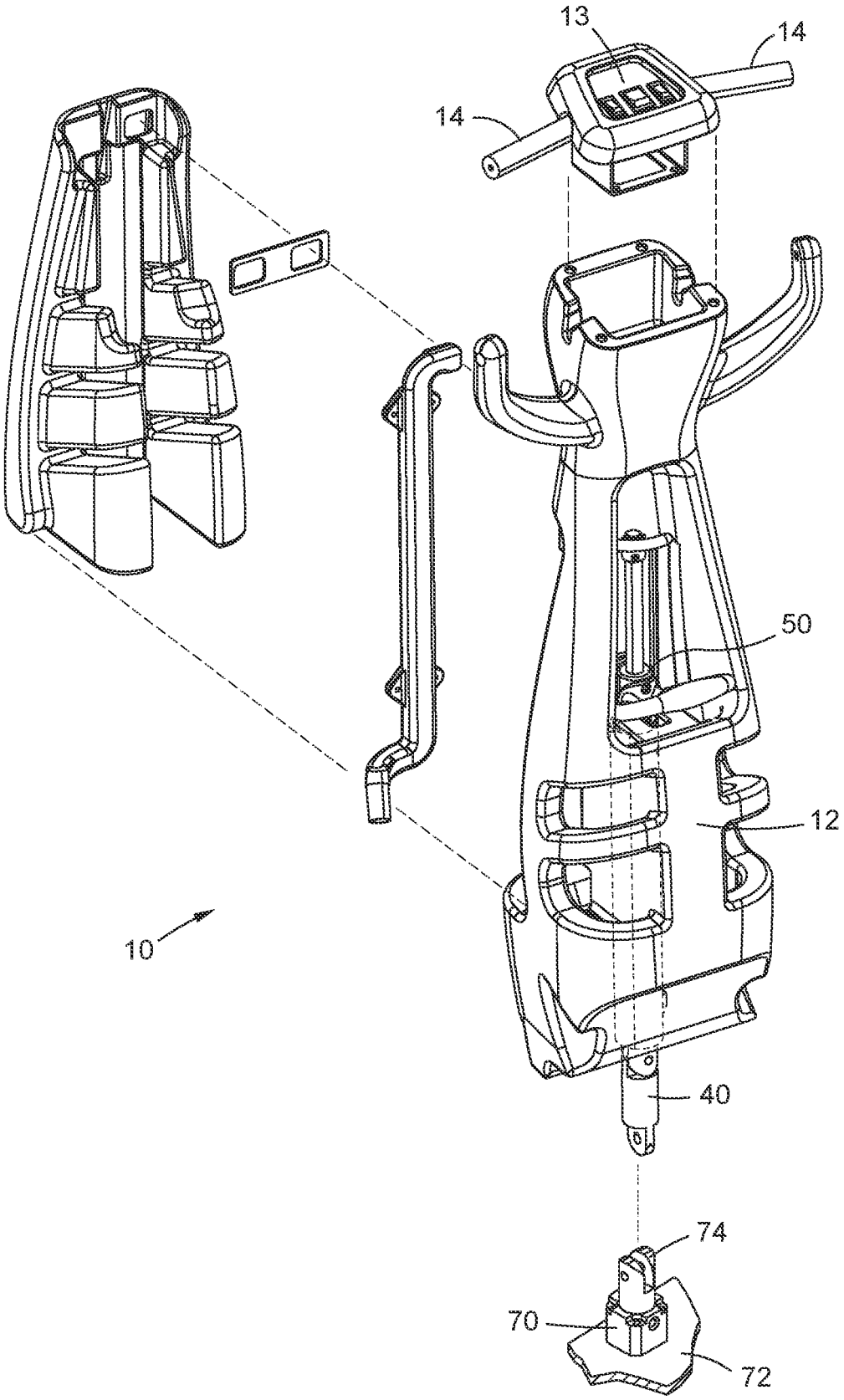
FIG. 6 is a partially exploded perspective rear view of an apparatus according to the present invention, with the base assembly mostly omitted from view and with some internal components of the handle assembly shown in dashed hidden lines.
Figure 7:
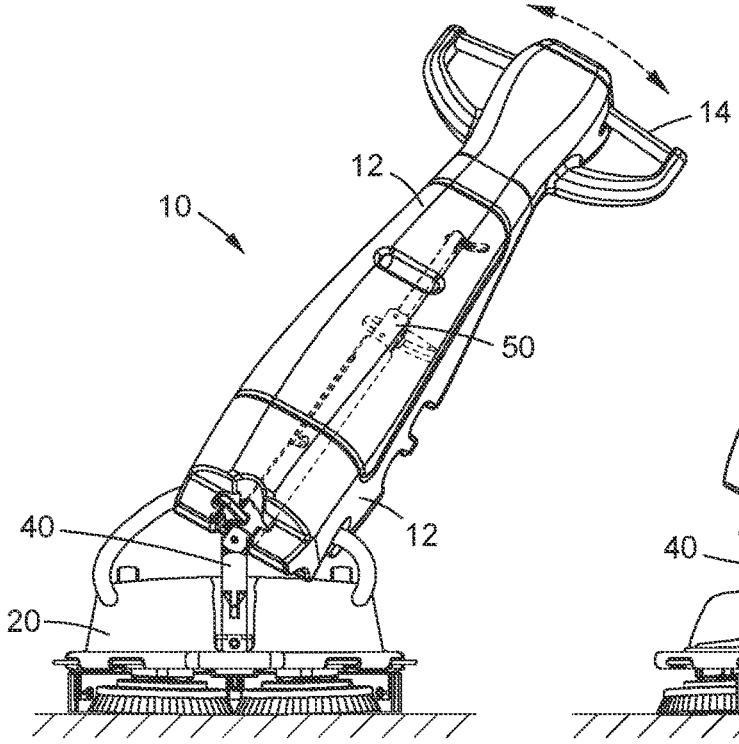
FIG. 7 is a front view of an apparatus according to the present invention upon a floor, and showing with directional arrows a selective pivotal lateral (side-to-side) tilting of the handle assembly relative to the base assembly and the floor.
Figure 8:
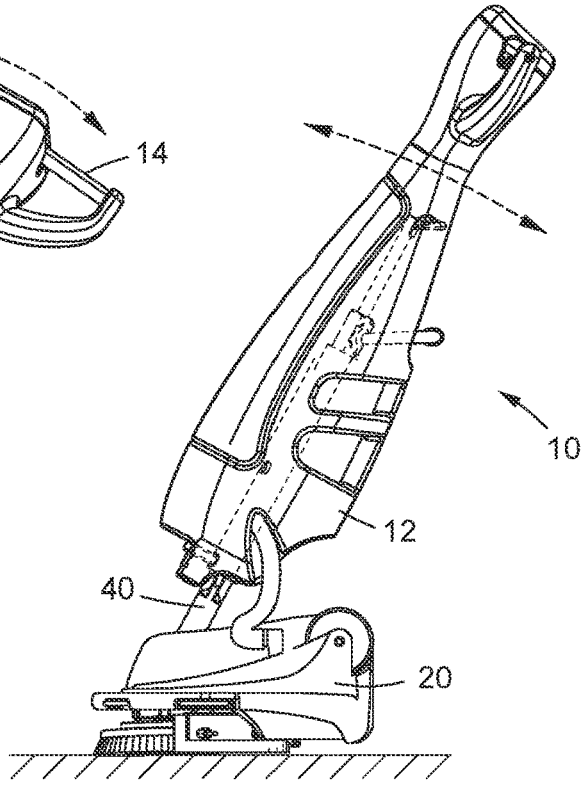
FIG. 8 is a left side view of the apparatus according to the present invention upon a floor, and showing with directional arrows a pivotal front-to-back or back-to-front tilting of the handle assembly relative to the base assembly and the floor.

Continuing reference is invited to FIGS. 1-4, as well as combined attention to FIGS. 5 and 6. The handle assembly 12 is movably secured to the base assembly 20 by means of a specialized species of universal joint (to be described further herein) including an intermediate linking member 40, which connects a main handle shaft 52 (within the handle assembly) to a mounting hub 70 on a base plate 72 in/on the base assembly. (See also FIG. 11.) This universal joint configuration permits the handle assembly 12 to be controllably swiveled and tilted, relative to the base assembly 20, in, through, and to a wide variety of positions in three-dimensional space; i.e., in plan view the handle assembly 12 can be controllably swung or swiveled effectively through a 360° arc. Such positional versatility reduces the physical labor demanded from the user, facilitates steering of the apparatus 10 during use, and allows optimization of the handle assembly 12 position in space while cleaning in and around objects and obstacles upon the floor.

Figure 9:
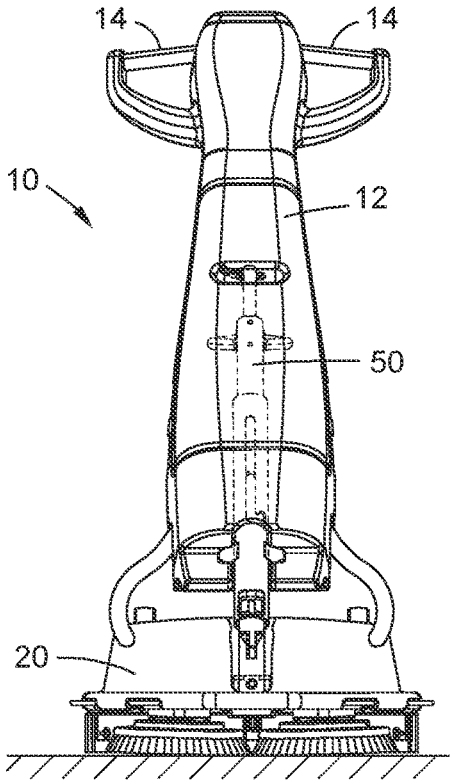
FIG. 9 is a front view of the apparatus according to the present invention, in use to scrub a floor.
Figure 10:
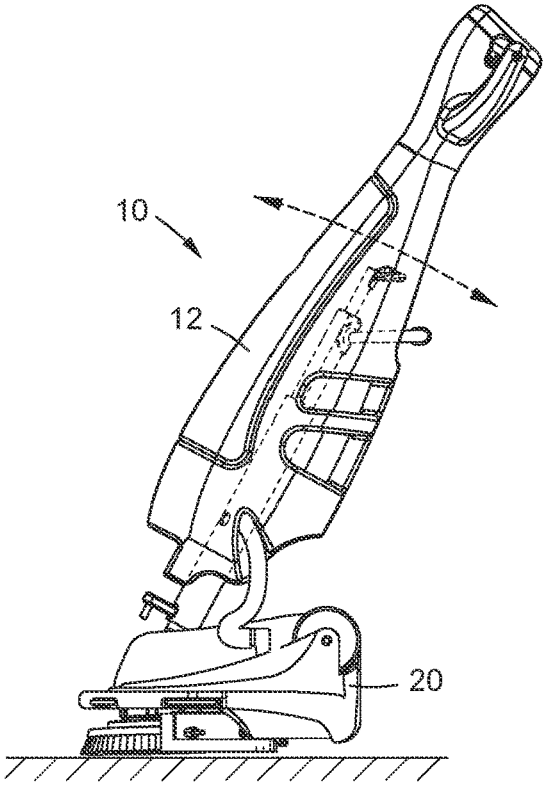
FIG. 10 is a left side view of the apparatus, similar to FIG. 8, showing with hidden dashed lines an alternative positioning of an internal lockable joint assembly according to the present invention.

Thus it is desirable, during the operation of the apparatus 10 during floor cleaning, that the handle assembly 12 be pivotally connected to the base assembly 20 in a manner which permits it to be tilted in nearly any direction, and at practically any angle, relative to the base assembly (and thus also to the floor). While it is conceivable that the handle assembly 12 may briefly be in a vertically upright position during cleaning operations, as seen in FIGS. 3 and 4, such a strictly upright position is seldom obtained while the apparatus 10 is scrubbing the floor. Rather, attention is advanced to FIGS. 7-10, depicting selected examples of other positions the handle assembly 12 may assume, in relation to the base assembly 20 during use. The directional arrows of FIG. 7 suggest the desirability of having the handle assembly 12 be pivotal side-to-side (laterally), while the directional arrows of FIGS. 8 and 10 indicate the need to permit the handle assembly to pivot front-to-back in relation to the base assembly 20 during operation of the apparatus. (FIG. 9 is a front view of the apparatus 10, as may appear during active use, with the handle assembly 12 tilted backwards opposite the direction of apparatus forward travel.) By means of the particularized releasable locking joint of the apparatus 10, the top end of the handle assembly 12 can be "swung" in a circle centered at its juncture with the base assembly 20 to promote facile and versatile positional manipulation of the handle assembly by a user.

Figure 20:
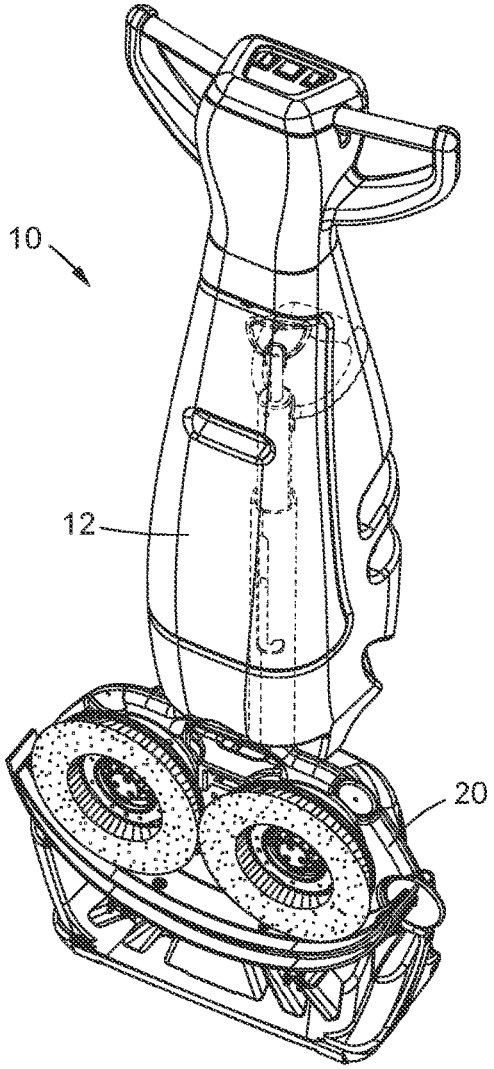
FIG. 20 is a front perspective view of an upright microscrubber apparatus according to the present invention, temporarily locked in the storage position.

Advancing attention to FIG. 20, it also is desirable to allow the apparatus 10 to be disposed in a storage position when powered off and not in use. In such storage position, which notion is known generally in the art, the apparatus 10 is arranged such that the base assembly 20 is pivoted relative to the vertically oriented handle assembly 12, so that scrubbing brushes 22 are lifted from the floor, and the body of the base assembly 20 is rotated to a position substantially parallel to the generally vertical upright handle assembly 12. In this storage position, the base assembly 20 has its rear or backside resting on the floor, partially supported also upon its wheels 26. The apparatus 10 preferably is releasably lockable in this storage position. As described further herein, the base assembly 20 may be temporarily locked in this storage position, relative to the upright handle assembly, by means of a releasable engagement with the handle assembly as configured in FIG. 20.

During the actual operation of the apparatus 10, it normally occasionally happens that the user wishes briefly and temporarily to pause the active cleaning functions, such as when the user must momentarily step away from the apparatus before the completion of the project or discrete portion of the project. Such a happenstance may be occasioned, for example, by the operator's need to move furniture, go to the restroom, open a door, or to change/add the cleaning solution in the apparatus 10, etc. In such instances, it is preferable that the apparatus 10 have a means whereby the handle assembly 12 can be temporarily locked in the upright position seen in FIGS. 1-4. Microscrubbers known in the art normally have no means for temporarily locking the handle assembly 12 in the vertically upright position. Typically in the prior art, when the user momentarily pauses cleaning operations and steps away from the microscrubber, the handle assembly is no longer supported by the user. Rather, when the user steps away she or he often merely lets go of the handle assembly. The unsupported handle assembly then is free to pivot in relation to the base assembly, and simply falls down to toward the floor until it is about horizontal and almost, or actually, in contact with the floor. Consequently, when the user returns to the microscrubber to resume cleaning the floor, he or she must bend over to retrieve the handle assembly from the near the floor. Sometimes, dropping a handle assembly can cause the microscrubber to tip over onto its side. More importantly, an unrestrained fall of the handle assembly to the floor, when the user steps away, may result in damage to the microscrubber.

An advantage of the present apparatus 10 is that it incorporates means to controllably and releasably lock the handle assembly 12 in the upright position of FIGS. 1-4. After disengaging and/or turning off appropriate apparatus functions (i.e., the rotary motion of the scrubbing brushes 22, and/or water pumps), the user may temporarily lock the handle assembly 12 in the upright position while he or she steps aside to attend to some auxiliary or unrelated task. When in the fully locked upright configuration, the handle assembly 12 of the present apparatus 10 does not fall toward the floor, but instead remains in convenient position for resumed use when the operator returns to task. Moreover, the capability to releasably lock the handle assembly 12 in the upright position does not, in the present apparatus 10, interfere with a user's ability to pivot the handle assembly 12 into any of a wide variety of tilted use positions, after the joint has been unlocked and released. Additionally, mechanisms of the present apparatus 10 for releasably locking the handle assembly 12 in the vertical upright position also are beneficially used alternatively to releasably yet reliably lock the handle assembly 12 in the storage position of FIG. 20.

As explained previously, and referring generally and collectively to FIGS. 1-6 and 11, the handle assembly 12 is connected to but widely pivotal in relation to, the base assembly 20. The connection primarily is by the specialized universal type of joint that includes an intermediate linking member 40, which connects a main handle shaft 52 secured within the handle assembly 12 to a mounting hub 70 on a base plate 72 of the base assembly 20. The u-joint is included within in a releasable, lockable, joint assembly which permits the handle assembly 12 to easily be releasably locked, in relation to the base assembly, in either the upright position seen in FIGS. 1-4, or the storage position seen in FIG. 20.

Figure 11:
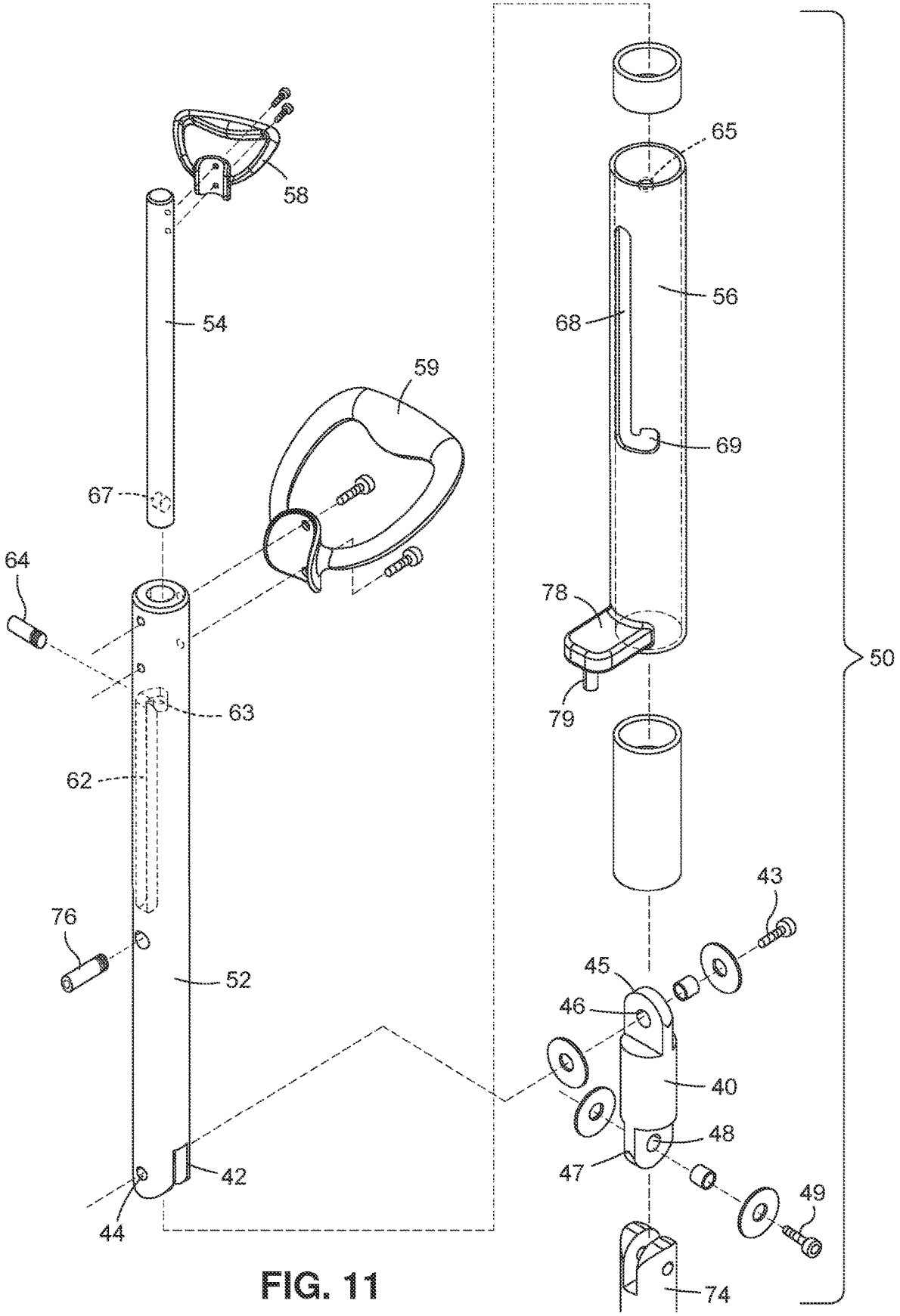
FIG. 11 is an enlarged exploded view showing the arrangement of components for a releasably lockable joint assembly useable internally within an upright scrubber apparatus according to the present invention; other surrounding components of the apparatus handle assembly and base assembly are omitted from view.
Figure 12:
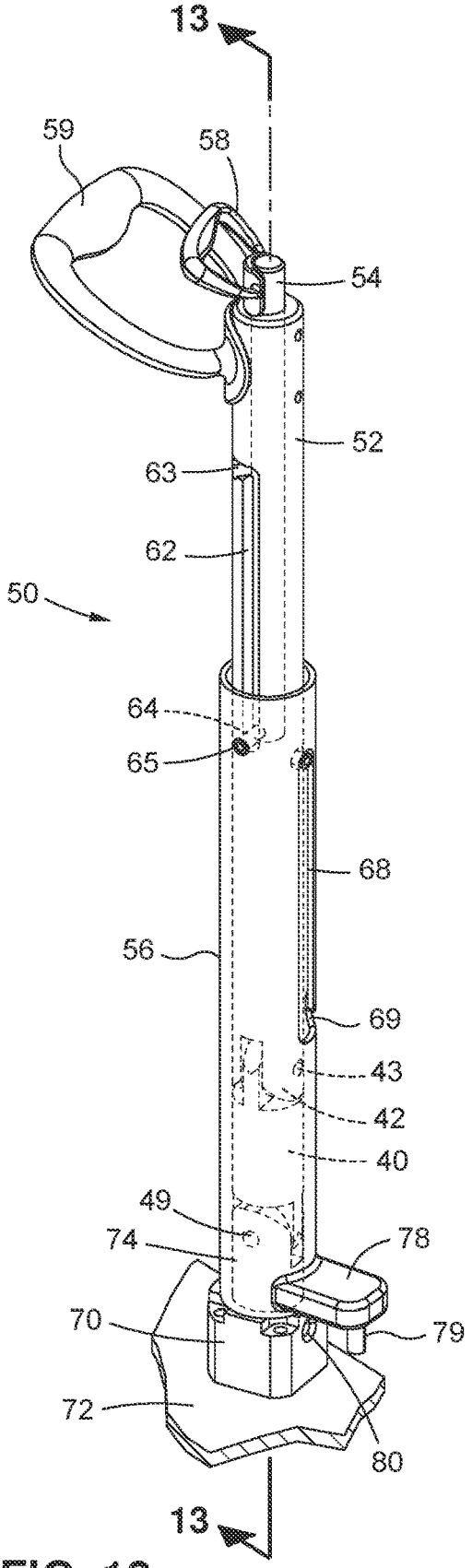
FIG. 12 is a perspective view of the internal releasably lockable joint assembly seen in FIG. 11, showing the lockable joint assembly in an assembled state and in a fully locked configuration.

Attention is turned to FIGS. 11 and 12, which depict the elements of the articulated, releasably lockable joint assembly 50 according to the present disclosure, and for use in the microscrubber apparatus 10. The releasable, lockable, joint assembly 50 features joint elements that when surrounded by a controllably slidable sleeve are prevented from swiveling, thereby to immobilize the handle assembly 12; yet when the sleeve is withdrawn from around the joint elements, they are free to pivotally articulate, so that the handle assembly 12 is controllably movable relative to the base assembly 20 using handle grips 14.

Figure 13:
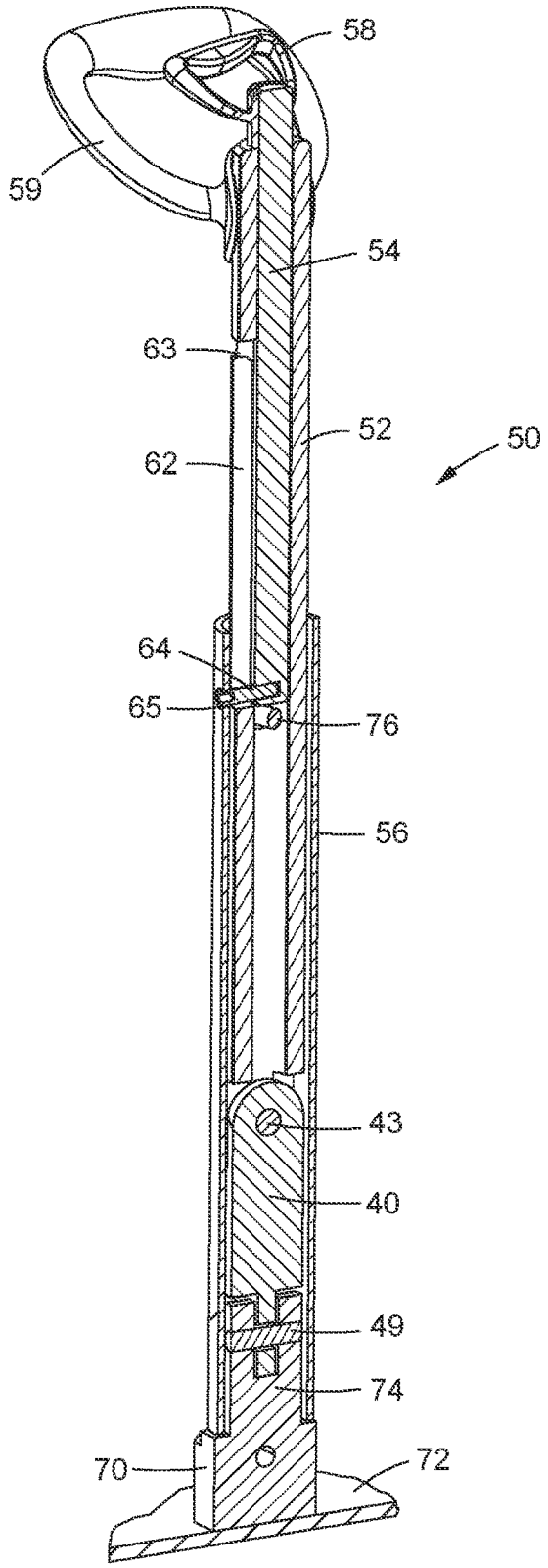
FIG. 13 is a sagittal sectional view of the internal releasably lockable joint assembly of FIG. 12, taken along section 13-13 of FIG. 12.

The releasably lockable joint assembly 50 of the apparatus 10 includes a number of components, seen in FIGS. 11-13, most of which are situated generally centrally within the interior of the handle assembly 12. The elements of the assembly 50 are preferably fabricated from metal alloys and/or rigid plastics, so to be substantially rigid, strong, and durable. Some of the principal components of the lockable joint assembly are the hollow, generally tubular main handle shaft 52, a control shaft 54, a rigid tubular locking sleeve 56, the linking member 40, and a base clevis 74. The base clevis 74 is connected to the base assembly 20, e.g., is secured to, or integrated with, the mounting hub 70 (see, e.g., FIGS. 1, 3, 5-6, and 14) of the base assembly. A lock control handle 58 is affixed (e.g., with screws as seen in FIG. 11) to the proximal or upper end of the control shaft 54. The upper end of the main handle shaft 52 has a shaft handle grip 59 secured thereto, for example with screws as indicated in FIG. 11.

Continued reference is made particularly to FIGS. 11 and 13. The control shaft 54 is snugly but slidably disposed into the interior of the tubular main handle shaft 52, so as to be readily movable axially within the main handle shaft. The control shaft 54 also is rotatable concentrically within the main handle shaft 52. The control shaft 54 extends from the proximal, or top, end of the main handle shaft 52. The rigid tubular locking sleeve 56 has an inside diameter slightly greater than the outside diameter of the main handle shaft 52, surrounds circumferentially a major length of the main handle shaft, and is slidable axially up and down along the exterior of the main handle shaft 52. The distal or lower terminus of the main handle shaft 52 is provided with, or defines, a shaft clevis-type yoke 42 with aligned fastener holes 44 therein.

The linking member 40 functions as an intermediate connector between the lower end of the main handle shaft 52 and the base clevis 74 that is secured within the base assembly 20. The linking member 40 is somewhat analogous to the "spider" or cross-piece of a conventional simple universal joint or cardan joint. Linking member 40 preferably is generally cylindrical, with an outside diameter approximately corresponding to the outer diameter of the main handle shaft 52. The linking member 40 has an upper flange 45 penetrated by an upper flange fastener hole 46, and a lower flange 47, which is similarly penetrated by a lower flange fastener hole 48. As illustrated by FIG. 11, the lower flange 47 is angularly offset, circumferentially, ninety degrees (90°) relative to the upper flange 45.

The base clevis 74 preferably is integral with the mounting hub 70, as suggested in FIGS. 6 and 13, while the mounting hub 70 is reliably and essentially permanently fixed to the base plate 72. The base plate 72 is foundational within the base assembly 20. Accordingly, the base clevis 74 serves as an anchor for the linking member 40 (and thus the entire lockable joint assembly 50) to the base assembly 20.

In this disclosure and in the claims, "clevis, "base clevis," and "clevis yoke" are used conveniently to characterize a preferred mode of pivotal connection, but the pivot provided by clevis type connections herein is not so limited. A pivotal connection provided by a clevis herein expressly includes any functionally equivalent structure that may be used to operably connect one element to another element, and that allows relative angular movement between the connected components. An operative connection may allow for one component to move in relation to another while constraining movement in one or more degrees of freedom. For example, one degree of freedom may be pivoting about an axis. In one embodiment, a pivot may be formed from a journal or through hole in one component and an axle in another component. In other alternative embodiments, pivots may include ball and socket joints. Yet other examples of pivots include, but are not limited to, singular embodiments and combinations of, compliant mounts, sandwich style mounts, flexible couplings, flexure pivots, journals, holes, pins, bolts, and other fasteners.

The main handle shaft's clevis yoke 42 is pivotally connected, by means of a first fastener 43 such as a screw or clevis pin, to the upper flange 45 of the linking member 40. This hinge-like connection is provided by disposing the first fastener 43 through the holes 44 in the clevis yoke 42, and the upper flange fastener hole 46 of the linking member 40, the holes 44 and 46 being in co-registration. As shown in FIG. 11, this pivotal connection between the linking member 40 and the main handle shaft 52 may be supplemented and facilitated with washers and/or cylinder bushings (shown but not labeled) in manners known to the art. The main handle shaft 52 accordingly is pivotal, through and up to a nearly or approximately 180° arc, in the imaginary plane containing or corresponding to the upper flange 45, and relative to the linking member 40. This first degree of freedom of pivotal movement permits the handle assembly 12 to be controllably swiveled laterally, from the vertical, in a side-to-side manner as suggested by FIG. 7.

The linking member's lower flange 47 is pivotably connected, by means of a second fastener 49 such as a screw or clevis pin, to the base clevis 74. This hinge-like connection is provided by disposing the second fastener 49 through holes in the base clevis 74, and the lower flange fastener hole 48 of the linking member 40, the several holes being in co-registration as suggested by FIG. 11. This pivotal connection between the linking member 40 and the base clevis 74 may be supplemented and facilitated with washers and/or cylinder bushings (also shown but not labeled in the drawing) in manners known to the art. The main handle shaft 52 accordingly also is pivotal, in the imaginary plane containing or corresponding to the lower flange 47, through an approximately or nearly 180° arc, relative to the base clevis 74. This second degree of freedom of pivotal movement permits the handle assembly 12 to be controllably swiveled forwardly and backwardly as suggested by FIGS. 8 and 10.

FIGS. 11-13 supply additional details regarding the interconnections between the main handle shaft 52, the control shaft 54, and the locking sleeve 56. It is observed that while the main handle shaft 52 is pivotal in many directions, it does not translate axially because it is connected to the linking member 40 which in turn is connected to the base clevis 74, which is secured to the base plate 72 that is immobile within the base assembly 20. However, the control shaft 54 can translate axially within the tubular main handle shaft 52, and the tubular locking sleeve 56 is capable of axial translation along the outside of the main handle shaft. FIG. 11 depicts a pair of optional cylinder bushings that, disposed concentrically between the main handle shaft 52 and the locking sleeve 56, may promote slippage between the inside of the locking sleeve and the outside surface of the main handle shaft.

A shaft slot 62 is defined through the wall of the main handle shaft 52. This shaft slot 62 is shaped as an elongated inverted "J", with a shaft slot lock notch 63 at its top end. The shaft slot 62 permits the control shaft 54 to be connected to the locking sleeve 56 by means of a shaft connector pin 64. The shaft connector pin 64 is disposed into a connector pin aperture 65 in the wall of an upper segment of the locking sleeve 56, passes through the shaft slot 62, and is secured to a lower or distal end portion of the control shaft 54, for example by being inserted into connector pin hole 67 in the control shaft. (See also, e.g., FIGS. 12 and 13.) Accordingly, the control shaft 54 and the locking sleeve 56, being interconnected by the shaft connector pin 64, move together unitarily, and are concurrently slidable axially in or along the main handle shaft 52. The shaft connector pin 64 is axially slidable in and along the entire length of the shaft slot 62. By the user's pulling (i.e., with the control handle 58) the control shaft maximally upward, followed by controlled twisting of the control shaft 54, the connector pin 64 can be deliberately settled into the shaft slot lock notch 63 to releasably lock the axial positions of the control shaft 54 and locking sleeve 56 in an uppermost position relative to the main handle shaft 52. With the control shaft 54 and locking sleeve 56 temporarily so locked in this uppermost position (see also, e.g., FIG. 14), the lockable joint assembly 50 is held in a "fully released" configuration which allows optimal pivotability to the handle assembly 12.

Figure 14:
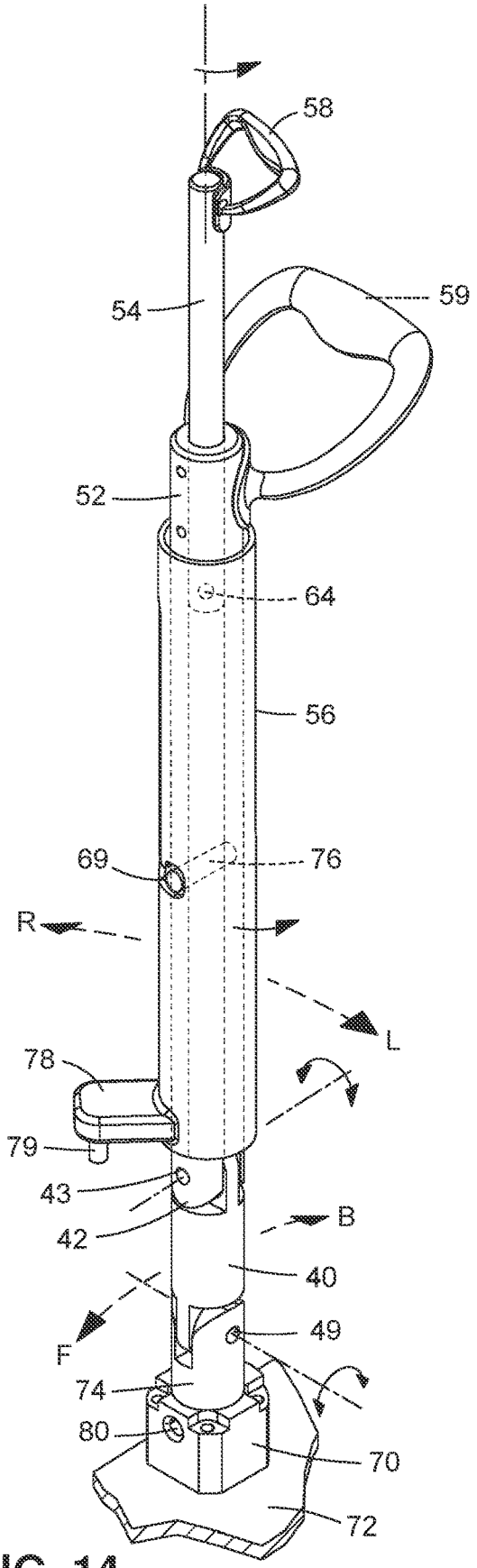
FIG. 14 is a perspective view of the releasably lockable joint assembly in a fully released configuration.
Figure 15:
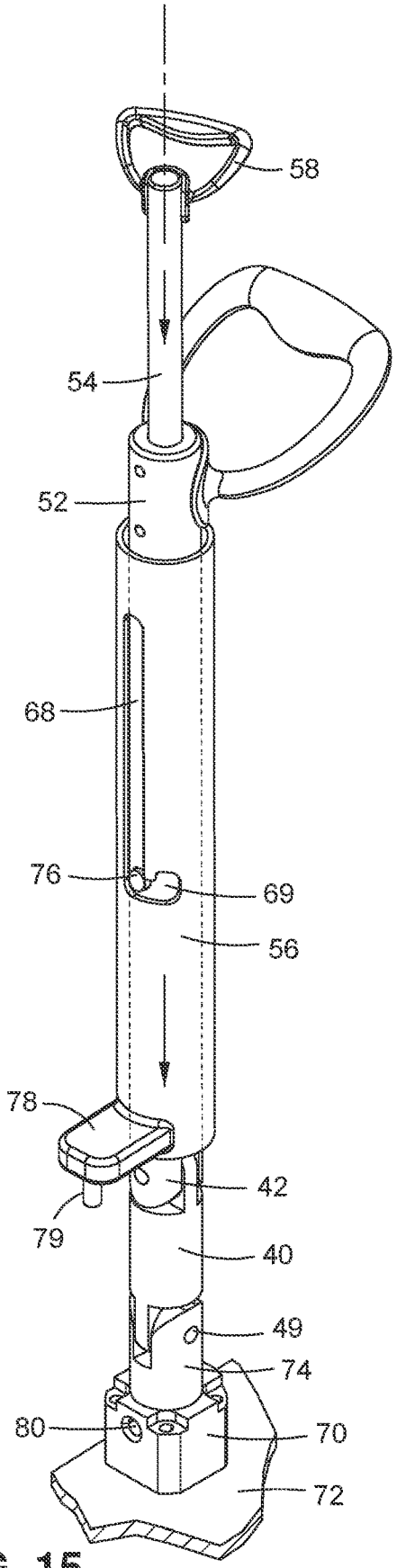
FIG. 15 is a perspective view of the lockable joint assembly in a released configuration, and but at the inception of being shifted toward a locked configuration.

A sleeve slot 68 is defined through an intermediate portion of the wall of the locking sleeve 56, as best seen in FIG. 11, as well as in FIG. 15. The sleeve slot 68 is shaped as an elongated backward "J" with a sleeve slot lock notch 69 at its bottom end. The sleeve slot 68 permits the sliding movement of the locking sleeve 56 (in relation to the main handle shaft 52) to be regulated by means of a sleeve control pin 76 secured to and extending out from the main handle shaft approximately medially along its length. The sleeve control pin 76 extends radially from the main handle shaft 52, out into the sleeve slot 68. As the locking sleeve 56 translates axially up or down on the main handle shaft 52, the sleeve control pin 76 slides along, and in, the sleeve slot 68. As also suggested in FIG. 14, the user's manually controlled rotation or twisting of the locking sleeve 56 (via manipulation of the control shaft 54 by means of the lock control handle 58) can place the sleeve control pin 76 into the sleeve slot lock notch 69, thereby to temporarily but releasably hold the locking sleeve in an upper ("fully release") position upon the main handle shaft 52, as will be further described.

Extending radially outward from the distal or bottom end of the locking sleeve 56 is a pin flange 78. Pin flange 78 is fixedly secured to the exterior of the locking sleeve 56 wall. Pin flange 78 has a hub pin 79 rigidly secured to its underside, which hub pin 79 extends axially distally downward from the flange 78 and thus the bottom end of the locking sleeve 56. In a manner to be further explained hereafter, the hub pin 79 is controllably insertable into a storage mount hole (element 80 in FIGS. 18 and 19) in the mounting hub 70, in a manner to be described, to temporarily lock the base assembly 20 (and handle assembly 12) in the storage position illustrated in FIG. 20.

Figure 16:
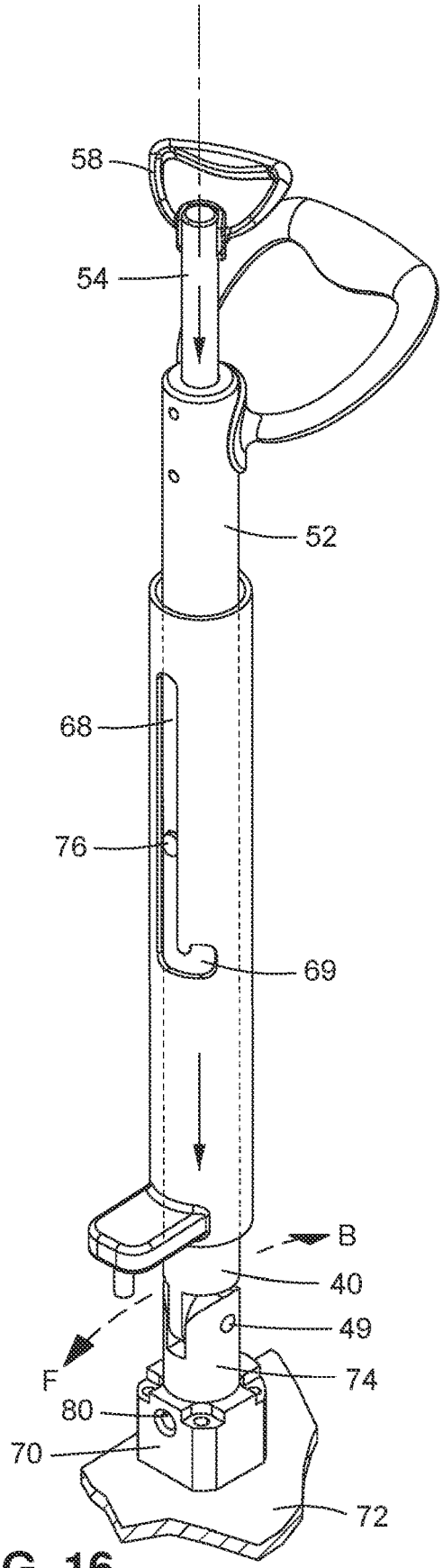
FIG. 16 a perspective view of the releasably lockable joint assembly of FIG. 15 in an intermediate configuration, moving toward a locked configuration.
Figure 17:
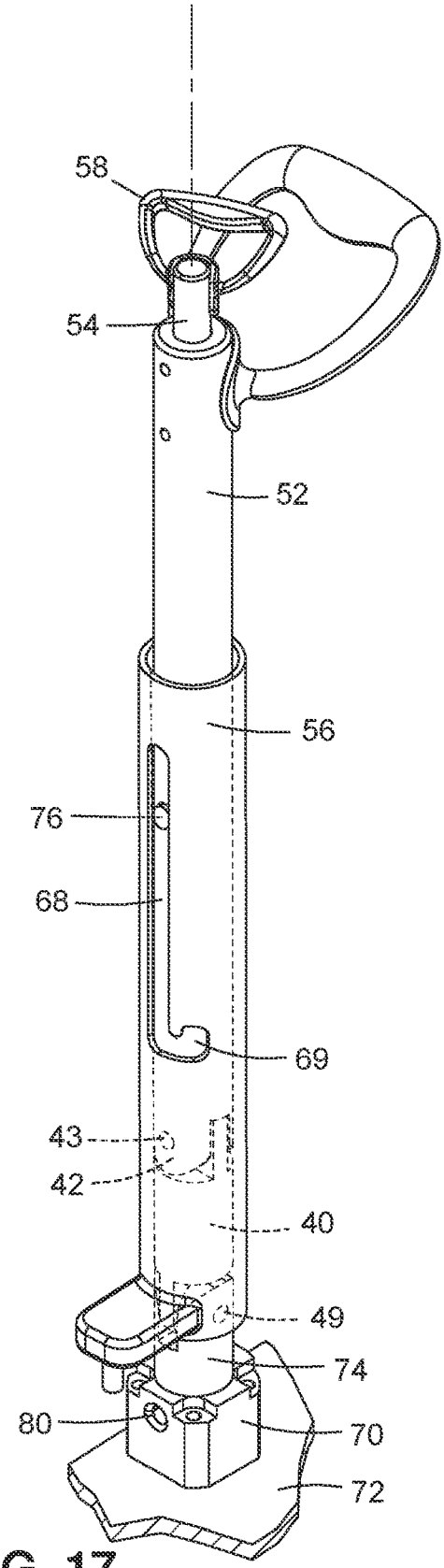
FIG. 17 is a perspective view of the releasably lockable joint assembly immediately prior to being moved into a fully locked configuration.

The function of the releasably lockable joint assembly 50 in the microscrubber apparatus 10, and the method according to the present disclosure, are further understood with combined reference to FIGS. 14-17. FIG. 14 depicts the lockable joint assembly 50 in the fully released configuration. In this position, the main handle shaft 52, and thus the handle assembly 12, is freely pivotal laterally side-to-side and front-to-back. FIG. 15 shows the releasably lockable joint assembly 50 immediately after the control shaft 54 has been twistably actuated to release the locking sleeve 56 to begin shifting the lockable joint assembly toward a locked configuration. In FIG. 15, however, the main handle shaft clevis yoke 42, the linking member 40, and the base clevis 74 are not yet covered or surrounded by the locking sleeve 65, so the handle assembly 12 can still be swiveled back and forth, or side to side. FIG. 16 illustrates the lockable joint assembly 50 after the locking sleeve 56 has been shifted partially down the main handle shaft 52 to cover the juncture between the main shaft clevis yoke 42 and the linking member's upper flange 45; this blocks or prohibits the hinged articulation between the main handle shaft 52 and the linking member 40, thereby preventing the handle assembly 12 from being pivotable side-to-side. FIG. 17 depicts the releasably lockable joint assembly 50 in a fully locked configuration (upright). The locking sleeve 56 in FIG. 17 has been slipped axially downward to surround not only the shaft clevis yoke 42 and the upper flange 45 of the linking member 40, but also to cover the juncture between the linking member's lower flange 47 and the base clevis 74 on the mounting hub 70. The locking sleeve 56 in this position thus blocks the hinged articulation between the linking member 40 and the base clevis 74, which prevents the handle assembly 12 from being pivotable frontward or backward.

As previously explained, when the microscrubber 10 is in active use to clean a floor surface, it is strongly preferred that the handle assembly 12 be free to pivot from the vertical, either side-to-side or front-and-back, as previously explained. Accordingly, during primary operative use of the upright scrubber 10, the user of the apparatus assures that the lockable joint assembly 50 is in the fully released configuration shown in FIG. 14. The control shaft 54 is maximally distended from the top end of the main handle shaft 52, and the lock control handle 58 is available to be grasped by the user when needed. The user's deliberate axial shifting of the control shaft 54 causes a corresponding and simultaneous shifting of the locking sleeve 56, because the shaft connector pin 64 fixedly connects the locking sleeve to the control shaft. Having been pulled up (e.g., by the handle 58) to the uppermost position of FIG. 14, the control shaft 54 has drawn the locking sleeve 56 to its uppermost position, with the top or proximal end of the locking sleeve just below the shaft handle grip 59. In the fully released configuration of FIG. 14, the control shaft 54 previously has been axially translated fully upward while the shaft connector pin 64 concurrently slid upward in and along the shaft slot 62; with the shaft connector pin 64 at the top of the shaft slot, the user (gripping the lock control handle 58) rotates the control shaft 54 clockwise (as viewed from above) to place the shaft connector pin 64 into the shaft slot lock notch 63. Correspondingly, in the fully released configuration of FIG. 14, the locking sleeve 56 has been translated fully upward while the sleeve control pin 76 moved down the sleeve slot 68. (Note that it is the locking sleeve 56 that translates axially relative to the sleeve control pin 76; the sleeve control pin 76 is fixed to the main handle shaft 52, which never undergoes any axial translation.) When the user twists the lock control handle 58 to rotate clockwise the control shaft 54, the sleeve control pin 76 engages into the sleeve slot lock notch 69 (while the shaft connector pin 64 similarly is engaged into the shaft slot lock notch 63). The placement of the shaft connector pin 64 within the shaft slot lock notch 63, and the engagement of the sleeve control pin 76 with the sleeve slot lock notch 69 releasably locks the releasably lockable joint assembly 50 in the fully released configuration of FIG. 14. The handle assembly 12 is thus freely pivotal for use.

The lockable joint assembly 50 thereby is in the fully released configuration. Fully released, the joint assembly 50 allows the linking member 40 to pivot freely about the axis defined by the lower, second fastener 49 (FIG. 14). As the linking member 40 pivots, so does the main handle shaft 52, and accordingly also the main handle assembly 12. The main handle shaft 52 (and the handle assembly 12) thus may be swiveled forward, as indicated by directional arrow F in FIG. 14, or backward, as indicated by directional arrow B. Moreover, in the fully released configuration, the lockable joint assembly 50 allows the main handle shaft clevis yoke 42 to pivot freely about the axis defined by the first, upper fastener 43. As the shaft clevis yoke 42 pivots, so does the main handle shaft 52, and accordingly also the main handle assembly 12. The main handle shaft 52 (and the handle assembly 12) thus may be swiveled laterally toward the left, as indicated by directional arrow L in FIG. 14, or to the right, as indicated by directional arrow R. The degrees of freedom afforded by the articulated junctions between the main handle shaft 52 and the linking member 40, and between the linking member 40 and the base clevis 74, foster wide versatility in the position of the handle assembly 12 during use, as may be desired by the user. With the releasably lockable joint assembly 50 in fully released configuration, the user holding onto the handle grips 14 can controllably tilt and tip the handle assembly 12 right or left (see, e.g., directional arrows of FIG. 7), and/or to-and-fro forward or backward (see, e.g., FIGS. 8 and 10) to maneuver the scrubber apparatus 10 in use. The handle assembly 12 accordingly can be tipped laterally side-to-side while concurrently also being tipped angularly rearward during comfortable use.

In the event the user wishes to temporarily lock the handle assembly 12 in an upright position while he or she steps away from the upright scrubber 10, the lockable joint assembly 50 advantageously supplies such a capability. In such circumstance, the user preferably first utilizes the control panel 13 to turn off, idle, or disengage the appropriate powered functions of the apparatus 10. With the scrubber "powered down," the user readily then manipulates the lock control handle 58 to regulate movements of the control shaft 54. Gripping the lock control handle 58, the user pushes slightly downward on the control shaft 54 while concurrently twistably rotating the control shaft 54 counterclockwise (viewed from above) a short angular distance as suggested by the uppermost unlabeled directional arrow in FIG. 14. This rotation of the control shaft 54 causes a concomitant rotation in the locking sleeve 56, as suggested by the second highest unlabeled directional arrow of FIG. 14. Referring jointly to FIGS. 14 and 15, it is seen that the counterclockwise rotary shift in the locking sleeve 56 disengages the sleeve control pin 76 from the sleeve slot lock notch 69. Simultaneously, the shaft connector pin 64 disengages from the shaft slot lock notch 63. With the pins 64, 76 displaced from their respective notches 63 and 69, the control shaft 54 and locking sleeve 56 may be slidably translated downward.

FIG. 15 illustrates that with the sleeve control pin 76 thus aligned with the major axis of the sleeve slot 68, the locking sleeve 56 is translated axially downward by the user's pushing downward on the lock control handle 58 (which sliding action may have a gravity assist), as indicated by the directional arrows of FIG. 15. Although not shown in FIGS. 14 and 15, the shaft connector pin 64 likewise is aligned with the major axis of the shaft slot 62 in the main handle shaft 52; as the sleeve 56 shifts downward, the shaft connector pin 64 moves down the main length of the shaft slot 62.

Continued downward movement of the control shaft 54 into the interior of the main handle shaft 52 results also in the axial downward translation of the locking sleeve 56 along the exterior of the main handle shaft 52. The movement of the control shaft 54 is continued, and the releasably lockable joint assembly 50 obtains the intermediate configuration seen in FIG. 16. In the intermediate configuration, the locking sleeve 56 surrounds the juncture between the shaft clevis yoke 42 and the linking member 40, in which instance only the linking member 40 and the base clevis 74 retain their hinged pivoting capability. Consequently, the linking member 40 and the main handle shaft 52 are locked against relative movement, and can swivel frontward or backward only, as indicted by the directional arrows of FIG. 16. With the lockable joint assembly 50 in the intermediate configuration of FIG. 16, the user can still pivot the handle assembly 12 forward or backward (e.g., as in FIG. 8).

Usually, however, the user continues to grip the lock control handle 58 and to push the control shaft 54 down. In FIG. 17, the lockable joint assembly 50 has reached nearly the full upright locked configuration. The sleeve control pin 76 has nearly obtained the uppermost extent of the sleeve slot 68, while the distal end of the locking sleeve 56 nearly contacts the top of the mounting hub 70. After the locking sleeve 56 has translated sufficiently downward, it surrounds the shaft clevis yoke 42, the linking member 40, and the base clevis 74 as indicated by FIG. 17. The locking sleeve's covering of the clevis yoke 42, linking member 40, and base clevis 74 arrests their mutual articulations, and the main handle shaft 52 is prohibited from any pivotal motion relative to the base plate 72 of the base assembly 20.

After the locking sleeve 56 has been moved to the bottom of its travel, the releasably lockable joint assembly 50 is in the fully locked configuration shown in FIGS. 12 and 13. The control shaft 54 is fully inserted into the main handle shaft 52, leaving the lock control handle 58 available at the proximal end of the main handle shaft. The sleeve control pin 76 is at the upper terminus of the sleeve slot 68, while the shaft connector pin 64 is against the bottom or distal terminus of the shaft slot 62. FIGS. 12 and 13 illustrate that with the distal end of the locking sleeve abutting the mounting hub 70, the shaft clevis yoke 42, linking member 40, and base clevis 74 are fully contained within the interior of the locking sleeve 56. The locking sleeve 56 thereby eliminates any freedom of movement of the main handle shaft 52 in relation to the linking member 40, or any freedom of movement of the linking member 40 in relation to the base clevis 74. The main handle shaft 52, and thus also the main handle assembly 12, are temporarily locked in the generally vertical, upright configuration or position seen in, for example, FIGS. 3 and 4. The user then is at liberty to let go of the handle grips 14 and walk away from the scrubber apparatus 10 with no concern for the handle assembly 12 pivotally falling to the floor.

Upon returning to the apparatus 10 as temporarily locked in the upright position, the user can release the handle assembly 12 for versatility of use by simply reversing the afore-described locking procedure. The user grasps the lock control handle 58 and pulls it upward, translating the locking sleeve 56 upward along the main handle shaft 52 until the sleeve has cleared the juncture between the linking member 40 and the main shaft clevis yoke 42. At this incidence, the main handle shaft 52 and the handle assembly 12 are freely pivotal laterally and forwardly/backwardly as described above. The user ordinarily will draw the locking sleeve 56 upward to its maximum translational extent—that is, till the sleeve control pin 76 contacts the bottom, distal terminus of the sleeve slot 68, and the shaft connector pin 64 is at or very near the top end of the shaft slot 62. At that point, the user may controllably twist the lock control handle 58 to rotate the locking sleeve 56 clockwise to engage the shaft connector pin 64 into the shaft slot lock notch 63, and the sleeve control pin 76 into the sleeve slot lock notch 69. With the pins 64, 76 thereby engaged with their corresponding lock notches 63, 69, the releasably lockable joint assembly 50 is restored to the fully released configuration of FIG. 14, and the user may reactivate the appropriate powered elements of the scrubber apparatus 10, and resume the floor cleaning project.

At the conclusion of a cleaning task, it is desirable to remove the scrubbing brushes 22 from the floor to prevent their drying in a deformed condition against the floor under the weight of the apparatus 10. Also, it is preferred to reduce the "footprint" of the apparatus to conserve storage space. Still further, it is desirable to place the upright scrubber 10 in a storage position, as seen in FIG. 20, in which position the wheels 26 come into rolling contact with the floor to facilitate the trundling movement of the apparatus to a storage location. The lockable joint assembly 50 provides easy conversion of the upright scrubber 10 from its use position (e.g., FIG. 9) to the storage configuration depicted in FIG. 20. The joint assembly 50 allows the handle assembly 12 and base assembly 20 to be releasably yet reliably locked in such storage position.

At the conclusion of cleaning operations, the microscrubber 10 is in any of its various potential use positions, some of which are seen in FIGS. 1-2 and 7-10. At such time, the releasably lockable joint assembly 50 is in its fully released configuration, as detailed hereinabove, with the locking sleeve 56 situated on the main handle shaft 52 but held in position above and clear of the articulated joint components 40, 42, 43, 44, 49 and 74. The handle assembly 12 consequently is freely pivotable side-to-side and forward/backward relative to the base assembly 20. As a result, the user while keeping the handle assembly 12 in a generally upright vertical position in space is able to swivel the base assembly 20 to place its back side and wheels 26 against the floor, as suggested by FIG. 20. In this storage configuration, the scrubbing brushes 22 desirably are out of contact with the floor, and the handle assembly 12 is upright; the apparatus 10 is thus well-configured to occupy minimal storage space, for example in a closet.

Figure 18:
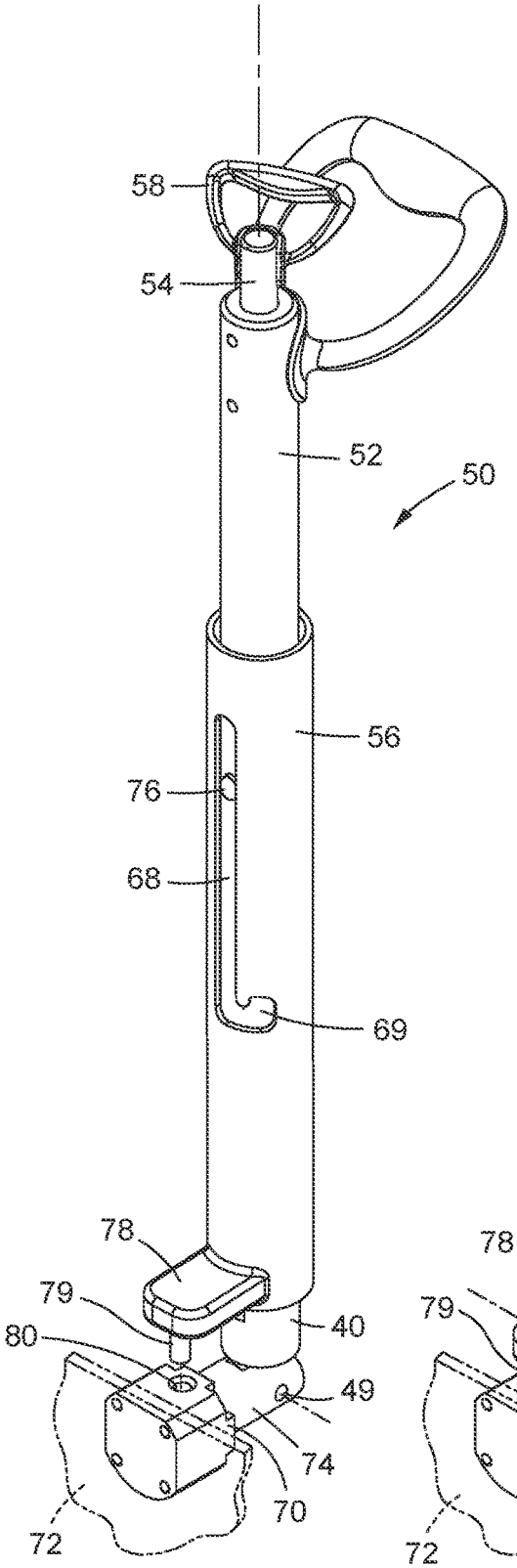
FIG. 18 is a perspective view of the releasably lockable joint assembly, in a position just prior to being moved into an alternative fully locked position to maintain the scrubber apparatus of the invention in a storage position.
Figure 19:
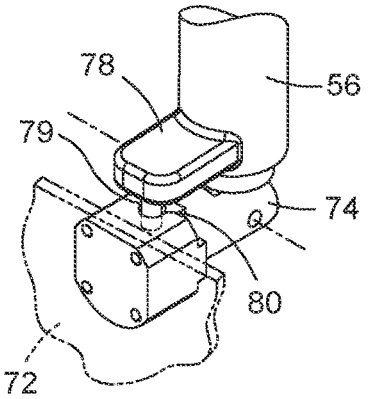
FIG. 19 shows a portion of the lockable joint assembly as seen in FIG. 18, illustrating the insertion of a pin into a mount hole to releasably lock the microscrubber apparatus in a storage position.

FIGS. 1, 3, 12, and 14-17 show that there is defined in the front of the mounting hub 70 a storage mount hole 80. When the microscrubber 10 is in the storage position of FIG. 20, the hub pin 79 is controllably insertable into the storage mount hole 80 to temporarily maintain the apparatus 10 in storage position. Particular attention is invited to FIGS. 18 and 19, illustrating how the releasably lockable joint assembly 50 is adapted to releasably lock the handle assembly and base assembly of the scrubber apparatus 10 in the storage configuration.

After the user manually has placed the microscrubber 10 into the storage position of FIG. 20, he or she manipulates the lockable joint assembly 50 into its full locked configuration. When initially placed into the storage configuration, the joint assembly 50 appears as seen in FIG. 18. It is noted that with the base assembly 20 swung up into its storage position, the base plate 72 of the base assembly 20 is drawn approximately parallel to the axis of the main handle shaft 52. FIG. 18 shows that the pin flange 78 is alignable with the mounting hub 70 on the base plate 72. With this alignment obtained, the hub pin 79 is in coaxial registration with the storage mount hole 80. The user then grips the lock control handle 58, and with it slidably shifts the locking sleeve 76 downward toward the mounting hub 70. The downward translation is continued until the hub pin 79 engages into the storage mount hole 80, as seen in FIG. 19. With the hub pin 79 inserted into the storage mount hole 80, the base member 20, and thus the microscrubber, is releasably locked in the storage position of FIG. 20.

When the time arrives to use the apparatus 10 in the next project, the user pulls upward on the lock control handle 58 to draw the locking sleeve 56 upward, which extracts the hub pin 79 from the storage mount hole 80. The base clevis 74 thus is freed to pivot around the lower second fastener 49, and the base assembly 20 can be swiveled into the use position with the scrubber brushes 22 against the floor. The releasably lockable joint assembly 50 can subsequently then be placed into the full release configuration of FIG. 14, and with the apparatus 10 powered on, the user can actuate the apparatus 10 using the control panel 13, and commence cleaning.

Although the invention has been described in detail with reference to these preferred embodiments, other embodiments can achieve the same results. The present apparatus can be practiced by employing generally conventional materials and equipment. Accordingly, the details of such materials and equipment are not set forth herein in detail. In this description, specific details are set forth, such as specific materials, structures, processes, etc., to provide a thorough understanding of the present invention. However, as one having ordinary skill in the art would recognize, the present invention can be practiced without resorting strictly only to the details specifically set forth. In other instances, well known processing structures have not been described in detail, in order not to unnecessarily obscure the present invention.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover by the appended claims all such modifications and equivalents.

What is claimed is:

1. A scrubber apparatus for cleaning floors, the apparatus having a base assembly, with a cleaning solution container thereon, disposable upon a floor and a handle assembly extending upwardly from the base assembly, comprising a releasably lockable joint assembly for connecting the handle assembly to the base assembly whereby the handle assembly may be temporarily disposed in a locked upright position in relation to the base assembly, and may be released for freely pivotal movement, in at least two degrees of freedom, in relation to the base assembly; and wherein the releasably lockable joint assembly comprises:

a main handle shaft;

a linking member;

a pivotal connection between the main handle shaft and the linking member;

a pivotal connection between the linking member and the base assembly; and a locking sleeve slidably disposed around the main handle shaft and slidable axially thereon to surround the linking member and to surround the pivotal connection between the main handle shaft and the linking member, and to surround the pivotal connection between the linking member and the base assembly;

wherein the releasably lockable joint assembly is movable between a fully locked configuration when the locking sleeve surrounds the linking member and the pivotal connections, and a fully released configuration when the locking sleeve is withdrawn from surrounding the linking member and the pivotal connections so that the handle assembly is freely pivotal in relation to the base assembly; and wherein the pivotal connection between the linking member and the base assembly comprises a base clevis pivotally connected to a bottom portion of the linking member, and fixedly connected to the base assembly.

2. The scrubber apparatus according to claim 1 further comprising:

a control shaft slidable axially within the main handle shaft; and a control handle on the control shaft with which the control shaft may be manually shifted upward or downward within the main handle shaft, and with which the control shaft may be manually rotated concentrically within the main handle shaft;

wherein the locking sleeve is interconnected with the control shaft and the locking sleeve and control shaft are movable together unitarily, and are concurrently slidable axially along the main handle shaft.

3. The scrubber apparatus according to claim 2 further comprising:

a shaft slot in and along the main handle shaft; and a shaft connector pin, disposed through the shaft slot, for connecting the control shaft to the locking sleeve;

wherein, when the control shaft and locking sleeve slide along the main handle shaft, the shaft connector pin moves along and within the shaft slot.

4. The scrubber apparatus according to claim 3, wherein:

the shaft slot defines an elongated inverted "J" shape with a shaft slot lock notch at a top end of the shaft slot; and the control shaft is rotatable within the main handle shaft to place the shaft connector pin into the shaft slot lock notch;

wherein placement of the shaft connector pin within the shaft slot lock notch releasably locks the releasably lockable joint assembly in the fully released configuration.

5. The scrubber apparatus according to claim 2 further comprising:

a sleeve slot in and along the locking sleeve; and a sleeve control pin extending radially from the main handle shaft and through the sleeve slot;

wherein, when the locking sleeve slides along the main handle shaft, the sleeve control pin moves along and within the sleeve slot.

6. The scrubber apparatus according to claim 5, wherein:

the sleeve slot defines an elongated backward "J" shape with a sleeve slot lock notch at a bottom end of the sleeve slot;

the locking sleeve is rotatable around the main handle shaft to engage the sleeve control pin into the sleeve slot lock notch;

wherein engagement of the sleeve control pin into the sleeve slot lock notch releasably locks the releasably lockable joint assembly in the fully released configuration.

7. The scrubber apparatus according to claim 1 wherein the base assembly is pivotable between a use position parallel to the floor and a storage position parallel to the handle assembly when oriented vertically upright, and further comprising:

a pin flange extending radially outward from a bottom end of the locking sleeve;

a hub pin extending axially downward from the pin flange; and a hub on the base assembly, the hub defining a storage mount hole therein;

wherein when the base assembly is pivoted to the storage position, the locking sleeve is slidable downward to insertably engage the hub pin into the storage mount hole, thereby to releasably lock the base assembly in the storage position.

8. The scrubber apparatus according to claim 1, wherein the releasably lockable joint assembly comprises:

a tubular main handle shaft within the handle assembly;

a control shaft slidable axially within the main handle shaft;

a tubular locking sleeve around the main handle shaft and slidable axially along the main handle shaft;

wherein the locking sleeve is interconnected with the control shaft and the locking sleeve and control shaft are movable together unitarily, and are concurrently slidable axially along the main handle shaft;

a linking member pivotally connected to a bottom end of the main handle shaft; and means for pivotally connecting the linking member to the base assembly;

wherein the releasably lockable joint assembly is movable between a fully locked configuration in which the locking sleeve surrounds the linking member and at least a portion of the means for pivotally connecting the linking member to the base assembly, wherein the handle assembly is disposed in the locked upright position, and a fully released configuration in which the locking sleeve is withdrawn from surrounding the linking member and any portion of the means for pivotally connecting the linking member, wherein the handle assembly is freely pivotal in relation to the base assembly.

9. The scrubber apparatus according to claim 8, wherein the means for pivotally connecting the linking member to the base assembly comprises a base clevis pivotally connected to a bottom portion of the linking member, and fixedly connected to the base assembly.

10. The scrubber apparatus according to claim 9, wherein when the releasably lockable joint assembly is in the fully locked configuration the locking sleeve prevents the linking member from pivoting relative to the main handle shaft, and prevents the linking member from pivoting relative to the base clevis.

11. The scrubber apparatus according to claim 8 further comprising a control handle on the control shaft with which the control shaft may be manually shifted upward or downward within the main handle shaft, or with which the control shaft may be manually rotated concentrically within the main handle shaft.

12. The scrubber apparatus according to claim 11 further comprising:

a shaft slot in and along the main handle shaft;

a sleeve slot in and along the locking sleeve;

a shaft connector pin, disposed through the shaft slot, for connecting the control shaft to the locking sleeve; and a sleeve control pin extending radially from the main handle shaft and through the sleeve slot;

wherein, when the control shaft and locking sleeve slide along the main handle shaft, the shaft connector pin moves along and within the shaft slot; and wherein, when the locking sleeve slides along the main handle shaft, the sleeve control pin moves along and within the sleeve slot.

13. The scrubber apparatus according to claim 12, wherein:

the shaft slot defines an elongated inverted "J" shape with a shaft slot lock notch at a top end of the shaft slot; and the sleeve slot defines an elongated backward "J" shape with a sleeve slot lock notch at a bottom end of the sleeve slot.

14. The scrubber apparatus according to claim 13, wherein:

the control shaft is rotatable within the main handle shaft to place the shaft connector pin into the shaft slot lock notch; and the locking sleeve is rotatable around the main handle shaft to engage the sleeve control pin into the sleeve slot lock notch;

wherein placement of the shaft connector pin within the shaft slot lock notch, and engagement of the sleeve control pin into the sleeve slot lock notch, releasably locks the releasably lockable joint assembly in the fully released configuration.

15. The scrubber apparatus according to claim 1, wherein the base assembly is pivotable between a use position parallel to the floor and a storage position parallel to the handle assembly when oriented vertically upright, and wherein the releasably lockable joint assembly comprises:

a tubular main handle shaft within the handle assembly;

a control shaft slidable axially within the main handle shaft;

a tubular locking sleeve around the main handle shaft and slidable axially along the main handle shaft;

wherein the locking sleeve is interconnected with the control shaft and the locking sleeve and control shaft are movable together unitarily, and are concurrently slidable axially along the main handle shaft;

a linking member pivotally connected to a bottom end of the main handle shaft; and means for pivotally connecting the linking member to the base assembly;

a pin flange extending radially outward from a bottom end of the locking sleeve;

a hub pin extending axially downward from the pin flange; and a hub on the base assembly, the hub defining a storage mount hole therein;

wherein when the base assembly is pivoted to the storage position, the locking sleeve is slidable downward to insertably engage the hub pin into the storage mount hole, thereby to releasably lock the base assembly in the storage position.

16. A scrubber apparatus for cleaning floors, the apparatus having a base assembly disposable upon a floor and a handle assembly extending upwardly from the base assembly, comprising a releasably lockable joint assembly for connecting the handle assembly to the base assembly, the releasably lockable joint assembly comprising:

a main handle shaft;

a linking member;

a pivotal connection between the main handle shaft and the linking member;

a pivotal connection between the linking member and the base assembly; and a locking sleeve slidably disposed around the main handle shaft and slidable axially thereon to surround the linking member and to surround the pivotal connection between the main handle shaft and the linking member, and to surround the pivotal connection between the linking member and the base assembly;

wherein the releasably lockable joint assembly is movable between a fully locked configuration when the locking sleeve surrounds the linking member and the pivotal connections, and a fully released configuration when the locking sleeve is withdrawn from surrounding the linking member and the pivotal connections so that the handle assembly is freely pivotal in relation to the base assembly; and whereby the handle assembly may be temporarily disposed in a locked upright position in relation to the base assembly, and may be released for freely pivotal movement, in at least two degrees of freedom, in relation to the base assembly.

17. The scrubber apparatus according to claim 16 further comprising:

a control shaft slidable axially within the main handle shaft; and a control handle on the control shaft with which the control shaft may be manually shifted upward or downward within the main handle shaft, and with which the control shaft may be manually rotated concentrically within the main handle shaft;

wherein the locking sleeve is interconnected with the control shaft and the locking sleeve and control shaft are movable together unitarily, and are concurrently slidable axially along the main handle shaft.

18. The scrubber apparatus according to claim 16 wherein the base assembly is pivotable between a use position parallel to the floor and a storage position parallel to the handle assembly when oriented vertically upright, and further comprising:

a pin flange extending radially outward from a bottom end of the locking sleeve;

a hub pin extending axially downward from the pin flange; and a hub on the base assembly, the hub defining a storage mount hole therein;

wherein when the base assembly is pivoted to the storage position, the locking sleeve is slidable downward to insertably engage the hub pin into the storage mount hole, thereby to releasably lock the base assembly in the storage position.

* * * * *